US009255450B2

(12) United States Patent
Jain et al.

(10) Patent No.: US 9,255,450 B2
(45) Date of Patent: Feb. 9, 2016

(54) DRILL BIT WITH SELF-ADJUSTING PADS

(71) Applicants: Jayesh R. Jain, The Woodlands, TX (US); Juan Miguel Bilen, The Woodlands, TX (US)

(72) Inventors: Jayesh R. Jain, The Woodlands, TX (US); Juan Miguel Bilen, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 350 days.

(21) Appl. No.: 13/864,926

(22) Filed: Apr. 17, 2013

(65) Prior Publication Data

US 2014/0311801 A1 Oct. 23, 2014

(51) Int. Cl.

| | |
|---|---|
| ***E21B 10/62*** | (2006.01) |
| ***E21B 7/06*** | (2006.01) |
| ***E21B 10/54*** | (2006.01) |

(52) U.S. Cl.

CPC ..... *E21B 10/62* (2013.01); *E21B 7/064* (2013.01); *E21B 10/54* (2013.01); *E21B 2010/622* (2013.01)

(58) Field of Classification Search

CPC ... E21B 10/62; E21B 10/54; E21B 2010/622; E21B 7/064

See application file for complete search history.

(56) References Cited

U.S. PATENT DOCUMENTS

| | | | | |
|---|---|---|---|---|
| 1,612,338 | A * | 12/1926 | Wilson et al. | 173/15 |
| 3,050,122 | A * | 8/1962 | Huitt et al. | 166/55.8 |
| 3,422,672 | A * | 1/1969 | Payne | 73/152.53 |
| 3,583,501 | A * | 6/1971 | Aalund | 175/96 |
| 4,386,669 | A * | 6/1983 | Evans | 175/269 |
| 4,856,601 | A * | 8/1989 | Raney | 175/393 |
| 5,553,678 | A * | 9/1996 | Barr et al. | 175/73 |
| 6,142,250 | A * | 11/2000 | Griffin et al. | 175/381 |
| 7,971,662 | B2 | 7/2011 | Beuershausen | |
| 8,061,455 | B2 * | 11/2011 | Beuershausen | 175/426 |
| 8,205,686 | B2 * | 6/2012 | Beuershausen | 175/57 |
| 8,763,726 | B2 * | 7/2014 | Johnson et al. | 175/263 |
| 2007/0221416 | A1 * | 9/2007 | Hall et al. | 175/381 |
| 2007/0272445 | A1 | 11/2007 | Cariveau | |
| 2008/0000693 | A1 | 1/2008 | Hutton | |
| 2009/0044979 | A1 | 2/2009 | Johnson | |
| 2009/0107722 | A1 * | 4/2009 | Chen et al. | 175/25 |
| 2010/0071956 | A1 * | 3/2010 | Beuershausen | 175/61 |
| 2010/0212964 | A1 * | 8/2010 | Beuershausen | 175/57 |
| 2012/0255788 | A1 | 10/2012 | Schwefe | |
| 2013/0025358 | A1 * | 1/2013 | Radford et al. | 73/152.02 |
| 2014/0311801 | A1 * | 10/2014 | Jain et al. | 175/27 |

OTHER PUBLICATIONS

Jain, Jayesh R., et al.: "Mitigation of Torsional Stick-Slip Vibrations in Oil Well Drilling through PDC Bit Design: Putting Theories to the Test," SPE 146561, SPE Annual Technical Conference and Exhibition, Denver, Colorado, Oct. 30-Nov. 2, 2011, pp. 1-14.

International Search Report and Written Opinion for PCT/US2014/034493; International Filing Date Apr. 17, 2014; Mail date Aug. 20, 2014; (16 pages).

* cited by examiner

*Primary Examiner* — Jennifer H Gay

(74) *Attorney, Agent, or Firm* — Cantor Colburn LLP

(57) ABSTRACT

A drill bit including a bit body and a pad. The pad extends from a retracted position to an extended position from a bit surface at a first rate and retracts from the extended position to a retracted position at a second rate that is less than the first rate.

20 Claims, 6 Drawing Sheets

DRILL BIT WITH SELF-ADJUSTING PADS

BACKGROUND

1. Field of the Disclosure

This disclosure relates generally to drill bits and systems that utilize same for drilling wellbores.

2. Background of the Art

Oil wells (also referred to as "wellbores" or "boreholes") are drilled with a drill string that includes a tubular member having a drilling assembly (also referred to as the "bottomhole assembly" or "BHA"). The BHA typically includes devices and sensors that provide information relating to a variety of parameters relating to the drilling operations ("drilling parameters"), behavior of the BHA ("BHA parameters") and parameters relating to the formation surrounding the wellbore ("formation parameters"). A drill bit attached to the bottom end of the BHA is rotated by rotating the drill string and/or by a drilling motor (also referred to as a "mud motor") in the BHA to disintegrate the rock formation to drill the wellbore. A large number of wellbores are drilled along contoured trajectories. For example, a single wellbore may include one or more vertical sections, deviated sections and horizontal sections through differing types of rock formations. When drilling progresses from a soft formation, such as sand, to a hard formation, such as shale, or vice versa, the rate of penetration (ROP) of the drill changes and can cause (decreases or increases) excessive fluctuations or vibration (lateral or torsional) in the drill bit. The ROP is typically controlled by controlling the weight-on-bit (WOB) and rotational speed (revolutions per minute or "RPM") of the drill bit so as to control drill bit fluctuations. The WOB is controlled by controlling the hook load at the surface and the RPM is controlled by controlling the drill string rotation at the surface and/or by controlling the drilling motor speed in the BHA. Controlling the drill bit fluctuations and ROP by such methods requires the drilling system or operator to take actions at the surface. The impact of such surface actions on the drill bit fluctuations is not substantially immediate. Drill bit aggressiveness contributes to the vibration, whirl and stick-slip for a given WOB and drill bit rotational speed. "Depth of Cut" (DOC) of a drill bit, generally defined as "the distance the drill bit advances along axially into the formation in one revolution", is a contributing factor relating to the drill bit aggressiveness. Controlling DOC can provide smoother borehole, avoid premature damage to the cutters and prolong operating life of the drill bit.

The disclosure herein provides a drill bit and drilling systems using the same configured to control the rate of change of instantaneous DOC of a drill bit during drilling of a wellbore.

SUMMARY

In one aspect, a drill bit is disclosed that in one embodiment includes a bit body and a pad that extends from a retracted position to an extended position from a bit surface at a first rate and retracts from the extended position to a retracted position at a second rate that is less than the first rate.

In another aspect, a method of drilling a wellbore is provided that in one embodiment includes: conveying a drill string having a drill bit at an end thereof, wherein the drill bit includes a bit body and a pad that extends from a retracted position to an extended position from a bit surface at a first rate and retracts from the extended position to a retracted position at a second rate that is less than the first rate; and drilling the wellbore using the drill string.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures, wherein like numerals have generally been assigned to like elements and in which.

DESCRIPTION OF THE EMBODIMENTS

Figure 1:
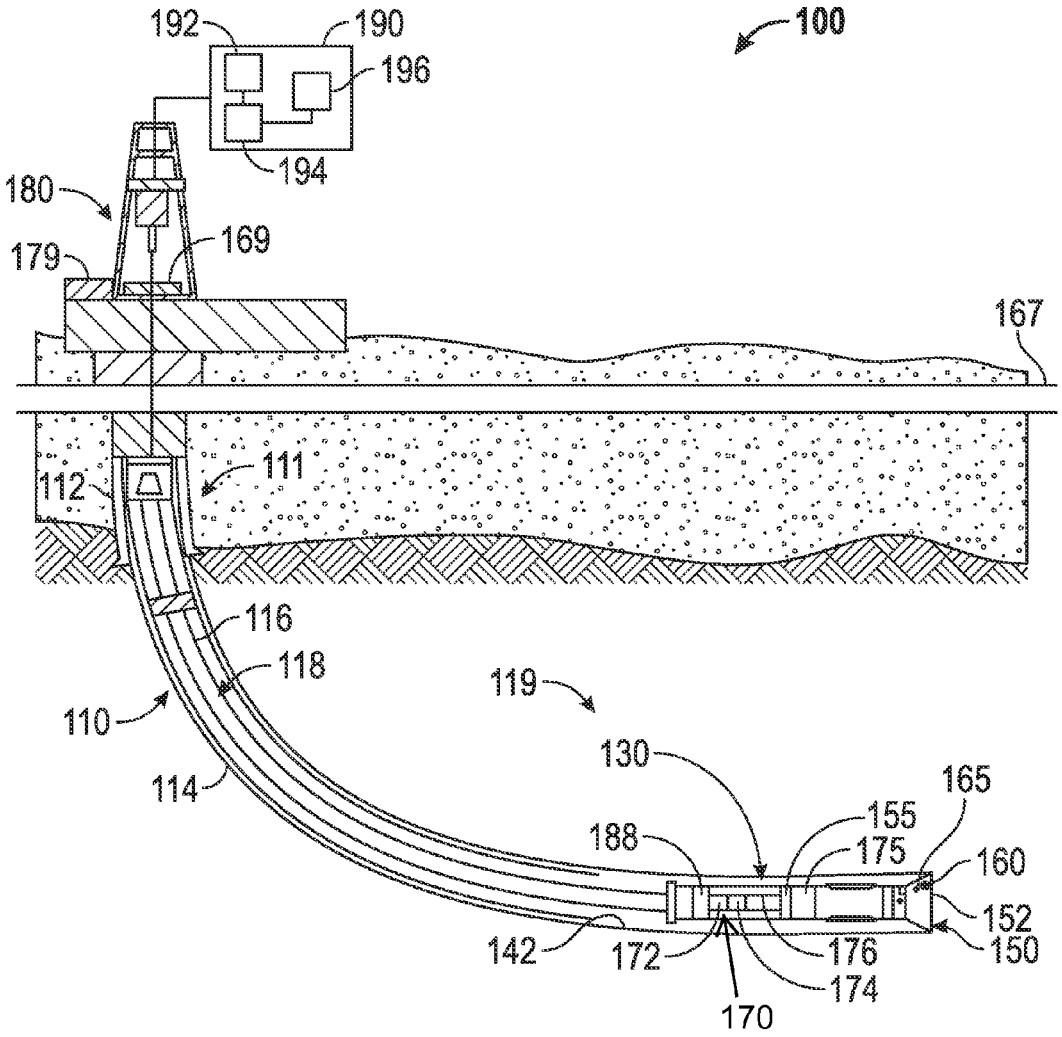
FIG. 1 is a schematic diagram of an exemplary drilling system that includes a drill string that has a drill bit made according to one embodiment of the disclosure.

FIG. 1 is a schematic diagram of an exemplary drilling system 100 that may utilize drill bits made according to the disclosure herein. FIG. 1 shows a wellbore 110 having an upper section 111 with a casing 112 installed therein and a lower section 114 being drilled with a drill string 118. The drill string 118 is shown to include a tubular member 116 with a BHA 130 attached at its bottom end. The tubular member 116 may be made up by joining drill pipe sections or it may be a coiled-tubing. A drill bit 150 is shown attached to the bottom end of the BHA 130 for disintegrating the rock formation 119 to drill the wellbore 110 of a selected diameter.

Drill string 118 is shown conveyed into the wellbore 110 from a rig 180 at the surface 167. The exemplary rig 180 shown is a land rig for ease of explanation. The apparatus and methods disclosed herein may also be utilized with an offshore rig used for drilling wellbores under water. A rotary table 169 or a top drive (not shown) coupled to the drill string 118 may be utilized to rotate the drill string 118 to rotate the BHA 130 and thus the drill bit 150 to drill the wellbore 110. A drilling motor 155 (also referred to as the "mud motor") may be provided in the BHA 130 to rotate the drill bit 150. The drilling motor 155 may be used alone to rotate the drill bit 150 or to superimpose the rotation of the drill bit by the drill string 118. A control unit (or controller) 190, which may be a computer-based unit, may be placed at the surface 167 to receive and process data transmitted by the sensors in the drill bit 150 and the sensors in the BHA 130, and to control selected operations of the various devices and sensors in the BHA 130. The surface controller 190, in one embodiment, may include a processor 192, a data storage device (or a computer-readable medium) 194 for storing data, algorithms and computer programs 196. The data storage device 194 may be any suitable device, including, but not limited to, a read-only memory (ROM), a random-access memory (RAM), a flash memory, a magnetic tape, a hard disk and an optical disk.

During drilling, a drilling fluid 179 from a source thereof is pumped under pressure into the tubular member 116. The drilling fluid discharges at the bottom of the drill bit 150 and returns to the surface via the annular space (also referred as the "annulus") between the drill string 118 and the inside wall 142 of the wellbore 110.

The BHA 130 may further include one or more downhole sensors (collectively designated by numeral 175). The sensors 175 may include any number and type of sensors, including, but not limited to, sensors generally known as the measurement-while-drilling (MWD) sensors or the logging-while-drilling (LWD) sensors, and sensors that provide information relating to the behavior of the BHA 130, such as drill bit rotation (revolutions per minute or "RPM"), tool face, pressure, vibration, whirl, bending, and stick-slip. The BHA 130 may further include a control unit (or controller) 170 that controls the operation of one or more devices and sensors in the BHA 130. The controller 170 may include, among other things, circuits to process the signals from sensor 175, a processor 172 (such as a microprocessor) to process the digitized signals, a data storage device 174 (such as a solid-state-memory), and a computer program 176. The processor 172 may process the digitized signals, and control downhole devices and sensors, and communicate data information with the controller 190 via a two-way telemetry unit 188.

Still referring to FIG. 1, the drill bit 150 includes a face section (or bottom section) 152. The face section 152 or a portion thereof faces the formation in front of the drill bit or the wellbore bottom during drilling. The drill bit 150, in one aspect, includes one or more pads 160 that may be extended and retracted from a selected surface of the drill bit 150. The pads 160 are also referred to herein as the "extensible pads," "extendable pads," or "adjustable pads." A suitable actuation device (or actuation unit) 165 in the drill bit 150 may be utilized to extend and retract one or more pads from a drill bit surface during drilling of the wellbore 110. In one aspect, the actuation device 165 may control the rate of extension and retraction of the pad 160. The actuation device is also referred to as a "rate control device" or "rate controller." In another aspect, the actuation device is a passive device that automatically adjusts or self-adjusts the extension and retraction of the pad 160 based on or in response to the force or pressure applied to the pad 160 during drilling. The rate of extension and retraction of the pad may be preset as described in more detail in reference to FIGS. 2-4.

Figure 2:
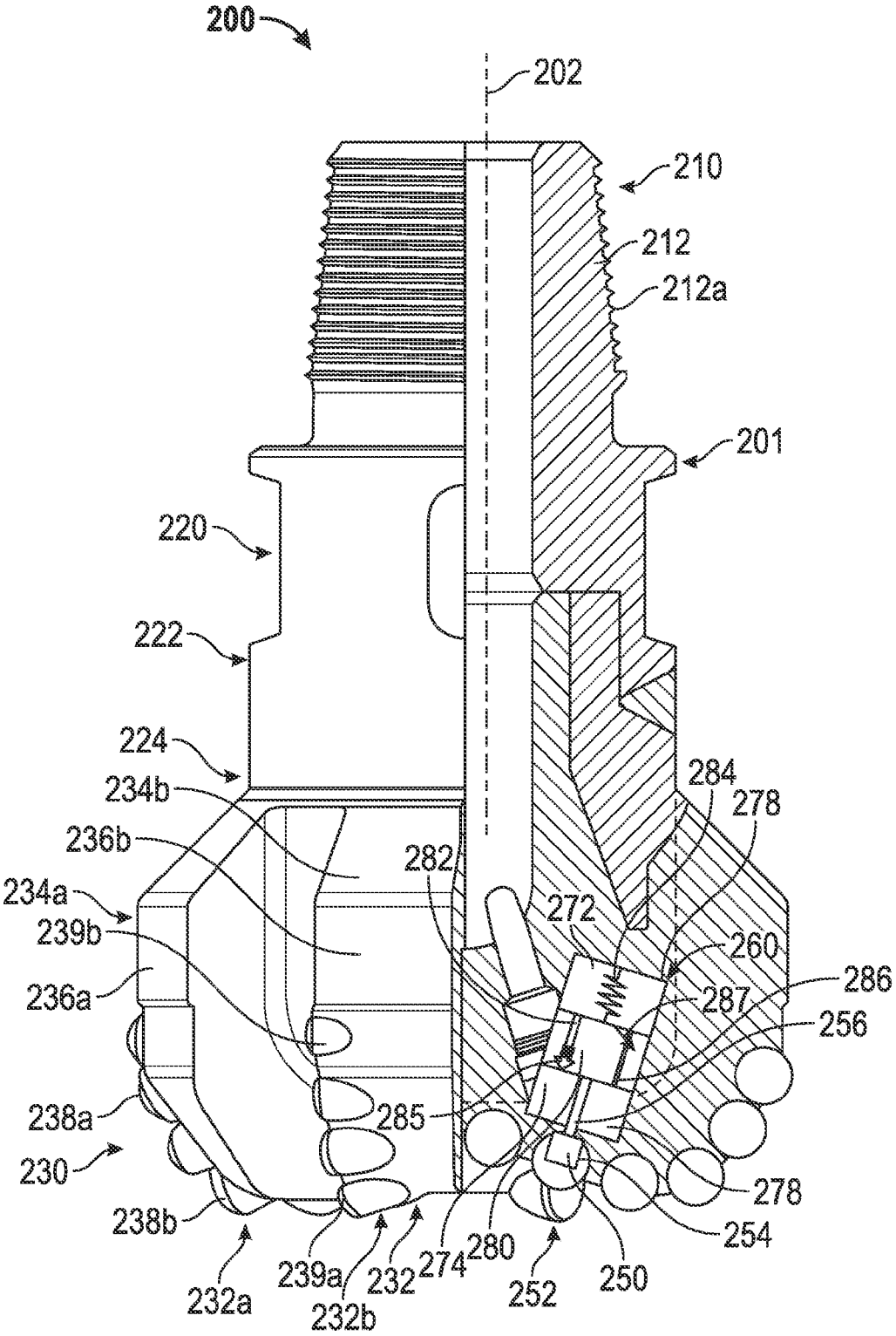
FIG. 2 shows an isometric view of an exemplary drill bit with a pad and a rate control device for controlling the rates of extending and retracting the pad from a drill bit surface, according to one embodiment of the disclosure.

FIG. 2 shows an exemplary drill bit 200 made according to one embodiment of the disclosure. The drill bit 200 is a polycrystalline diamond compact (PDC) bit having a bit body 201 that includes a neck or neck section 210, a shank 220 and a crown or crown section 230. The neck 210 has a tapered upper end 212 having threads 212*a* thereon for connecting the drill bit 200 to a box end of the drilling assembly 130 (FIG. 1). The shank 220 has a lower vertical or straight section 222 that is fixedly connected to the crown 230 at a joint 224. The crown 230 includes a face or face section 232 that faces the formation during drilling. The crown 230 includes a number of blades, such as blades 234*a*, 234*b*, etc. A typical PDC bit includes 3-7 blades. Each blade has a face (also referred to as a "face section") and a side (also referred to as a "side section"). For example, blade 234*a* has a face 232*a* and a side 236*a*, while blade 234*b* has a face 232*b* and a side 236*b*. The sides 236*a* and 236*b* extend along the longitudinal or vertical axis 202 of the drill bit 200. Each blade further includes a number of cutters. In the particular embodiment of FIG. 2, blade 234*a* is shown to include cutters 238*a* on a portion of the side 236*a* and cutters 238*b* along the face 232*a* while blade 234*b* is shown to include cutters 239*a* on the side 239*a* and cutters 239*b* on the face 232*b*.

Still referring to FIG. 2, the drill bit 200 includes one or more elements or members (also referred to herein as pads) that extend and retract from a surface 252 of the drill bit 200. FIG. 2 shows a pad 250 movably placed in a cavity or recess 254 in the crown section 230. An activation device 260 may be coupled to the pad 250 to extend and retract the pad 250 from a drill bit surface location 252. In one aspect, the activation device 260 controls the rate of extension and retraction of the pad 250. In another aspect, the device 260 extends the pad at a first rate and retracts the pad at a second rate. In embodiments, the first rate and second rate may be the same or different rates. In another aspect, the rate of extension of the pad 250 may be greater than the rate of retraction. As noted above, the device 260 also is referred to herein as a "rate control device" or a "rate controller." In the particular embodiment of the device 260, the pad 250 is directly coupled to the device 260 via a mechanical connection or connecting member 256. In one aspect, the device 260 includes a chamber 270 that houses a double acting reciprocating member, such as a piston 280, that sealingly divides the chamber 270 into a first chamber 272 and a second chamber 274. Both chambers 272 and 274 are filled with a hydraulic fluid 278 suitable for downhole use, such as oil. A biasing member, such as a spring 284, in the first chamber 272, applies a selected force on the piston 280 to cause it to move outward. Since the piston 280 is connected to the pad 250, moving the piston outward causes the pad 250 to extend from the surface 252 of the drill bit 200. In one aspect, the chambers 272 and 274 are in fluid communication with each other via a first fluid flow path or flow line 282 and a second fluid flow path or flow line 286. A flow control device, such as a check valve 285, placed in the fluid flow line 282, may be utilized to control the rate of flow of the fluid from chamber 274 to chamber 272. Similarly, another flow control device, such as a check valve 287, placed in fluid flow line 286, may be utilized to control the rate of flow of the fluid 278 from chamber 272 to chamber 274. The flow control devices 285 and 287 may be configured at the surface to set the rates of flow through fluid flow lines 282 and 286, respectively. I another aspect, the rates may be set or dynamically adjusted by an active device, such as by controlling fluid flows between the chambers by actively controlled valves. In one aspect, one or both flow control devices 285 and 287 may include a variable control biasing device, such as a spring, to provide a constant flow rate from one chamber to another. Constant fluid flow rate exchange between the chambers 272 and 274 provides a first constant rate for the extension for the piston 280 and a second constant rate for the retraction of the piston 280 and, thus, corresponding constant rates for extension and retraction of the pad 250. The size of the flow control lines 282 and 286 along with the setting of their corresponding biasing devices 285 and 287 define the flow rates through lines 282 and 286, respectively, and thus the corresponding rate of extension and retraction of the pad 250. In one aspect, the fluid flow line 282 and its corresponding flow control device 285 may be set such that when the drill bit 250 is not in use, i.e., there is no external force being applied onto the pad 250, the biasing member 280 will extend the pad 250 to the maximum extended position. In one aspect, the flow control line 282 may be configured so that the biasing member 280 extends the pad 250 relatively fast or suddenly. When the drill bit is in operation, such as during drilling of a wellbore, the weight on bit applied to the bit exerts an external force on the pad 250. This external force causes the pad 250 to apply a force or pressure on the piston 280 and thus on the biasing member 284.

In one aspect, the fluid flow line 286 may be configured to allow relatively slow flow rate of the fluid from chamber 272 into chamber 274, thereby causing the pad to retract relatively slowly. As an example, the extension rate of the pad 250 may be set so that the pad 250 extends from the fully retracted position to a fully extended position over a few seconds while it retracts from the fully extended position to the fully retracted position over one or several minutes or longer (such as between 2-5 minutes). It will be noted, that any suitable rate may be set for the extension and retraction of the pad 250. In one aspect, the device 260 is a passive device that adjusts the extension and retraction of a pad based on or in response to the force or pressure applied on the pad 250.

Figure 3:
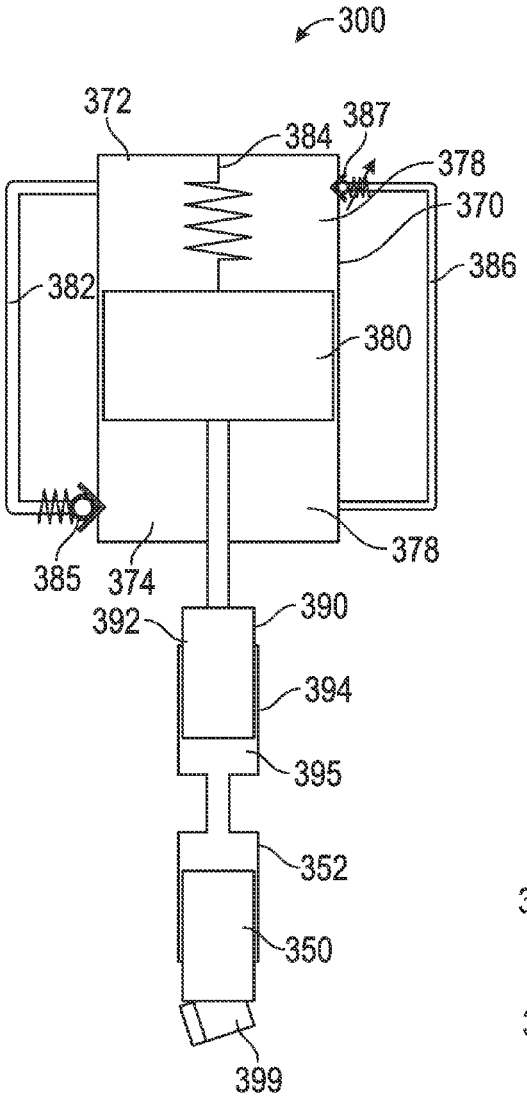
FIG. 3 shows an alternative embodiment of the rate control device that operates the pad via a hydraulic line.

FIG. 3 shows an alternative rate control device 300. The device 300 includes a fluid chamber 370 divided by a double acting piston 380 into a first chamber 372 and a second chamber 374. The chambers 372 and 374 are filled with a hydraulic fluid 378. A first fluid flow line 382 and an associated flow control device 385 allow the fluid 378 to flow from chamber 374 to chamber 372 at a first flow rate and a fluid flow line 386 and an associated flow control device 387 allow the fluid 378 to flow from the chamber 372 to chamber 374 at a second rate. The piston 380 is connected to a force transfer device 390 that includes a piston 392 in a chamber 394. The chamber 394 contains a hydraulic fluid 395, which is in fluid communication with a pad 350. In one aspect, the pad 350 may be placed in a chamber 352, which chamber is in fluid communication with the fluid 395 in chamber 394. When the biasing device 384 moves the piston 380 outward, it moves the piston 392 outward and into the chamber 394. Piston 392 expels fluid 395 from chamber 394 into the chamber 352, which extends the pad 350. When a force is applied on to the pad 350, it pushes the fluid in chamber 352 into chamber 394, which applies a force onto the piston 380. The rate of the movement of the piston 380 is controlled by the flow of the fluid through the fluid flow line 386 and flow control device 387. In the particular configuration shown in FIG. 3, the rate control device 300 is not directly connected to the pad 350, which enables isolation of the device 300 from the pad 350 and allows it to be located at any desired location in the drill bit, as described in reference to FIGS. 5-6. In another aspect, the pad 350 may be directly connected to a cutter 399 or an end of the pad 350 may be made as a cutter. In this configuration, the cutter 399 acts both as a cutter and an extendable and a retractable pad.

Figure 4:
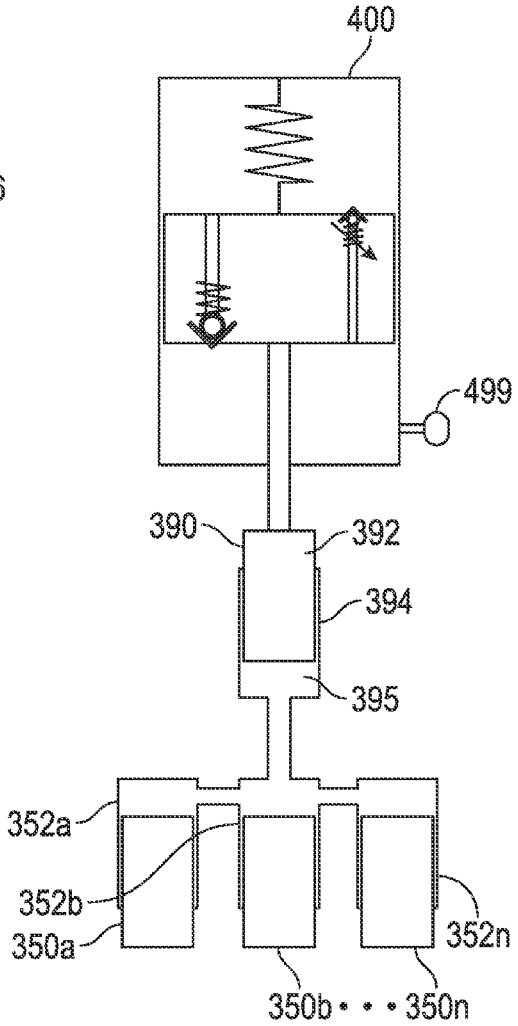
FIG. 4 shows an embodiment of a rate control device configured to operate multiple pads.

FIG. 4 shows a common rate control device 400 configured to operate more than one pad, such as pads 350*a*, 350*b* . . . 350*n*. The rate control device 400 is the same as shown and described in FIG. 2, except that it is shown to apply force onto the pads 350*a*, 350*b* . . . 350*n* via an intermediate device 390, as shown and described in reference to FIG. 3. In the embodiment of FIG. 4, each of the pads 350*a*, 350*b* . . . 350*n* is housed in separate chambers 352*a*, 352*b* . . . 352*n* respectively. The fluid 395 from chamber 394 is supplied to all chambers, thereby automatically and simultaneously extending and retracting each of the pads 350*a*, 350*b* . . . 350*n* based on external forces applied to each such pads during drilling. In aspects, the rate control device 400 may include a suitable pressure compensator 499 for downhole use. Similarly any of the rate controllers made according to any of the embodiments may employ a suitable pressure compensator.

Figure 5:
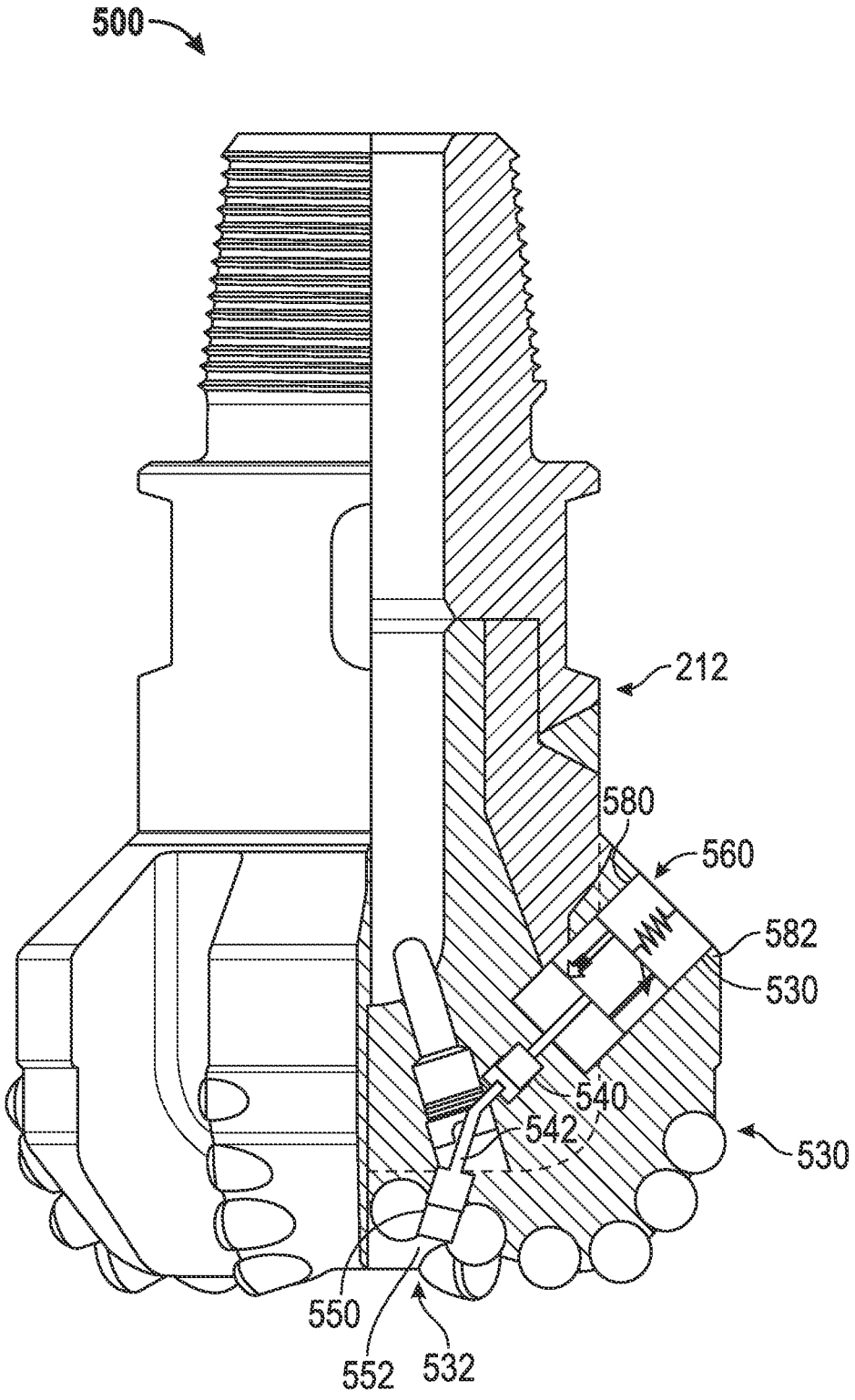
FIG. 5 shows placement of a rate control device of FIG. 4 in the crown section of the drill bit.

FIG. 5 shows an isometric view of a drill bit 500, wherein a rate control device 560 is placed in a crown section 530 of the drill bit 500. The rate control device 560 is the same as shown in FIG. 2, but is coupled to a pad 550 via a hydraulic connection 540 and a fluid line 542. The rate control device 560 is shown placed in a recess 580 accessible from an outside surface 582 of the crown section 530. The pad 550 is shown placed at a face location section 552 on the drill bit face 532, while the hydraulic connection 540 is shown placed in the crown 530 between the pad 550 and the rate control device 560. It should be noted that the rate control device 560 may be placed at any desired location in the drill bit, including in the shank 520 and neck section 510 and the hydraulic line 542 may be routed in any desired manner from the rate control device 560 to the pad 550. Such a configuration provides flexibility of placing the rate control device substantially anywhere in the drill bit.

Figure 6:
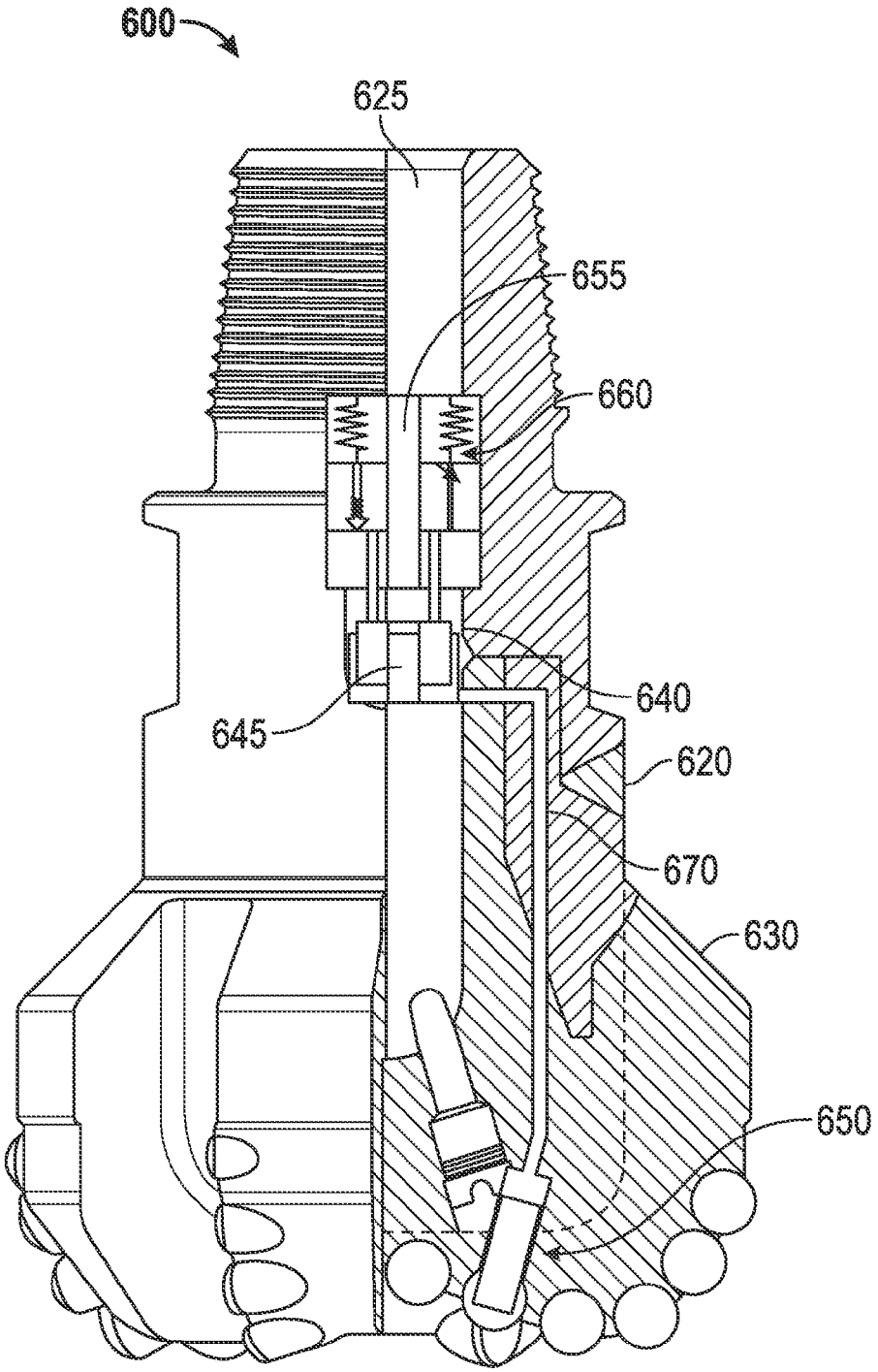
FIG. 6 shows placement of a rate control device of in fluid passage or flow path of the drill bit.

FIG. 6 shows an isometric view of a drill bit 600, wherein a rate control device 660 is placed in a fluid passage 625 of the drill bit 600. In the particular drill bit configuration of FIG. 6, the hydraulic connection 640 is placed proximate the rate control device 660. A hydraulic line 670 is run from the hydraulic connection 640 to the pad 650 through the shank 620 and the crown 630 of the drill bit 600. During drilling, a drilling fluid flows through the passage 625. To enable the drilling fluid to flow freely through the passage 625, the rate control device 660 may be provided with a through bore or passage 655 and the hydraulic connection device 640 may be provided with a flow passage 645.

Figure 7:
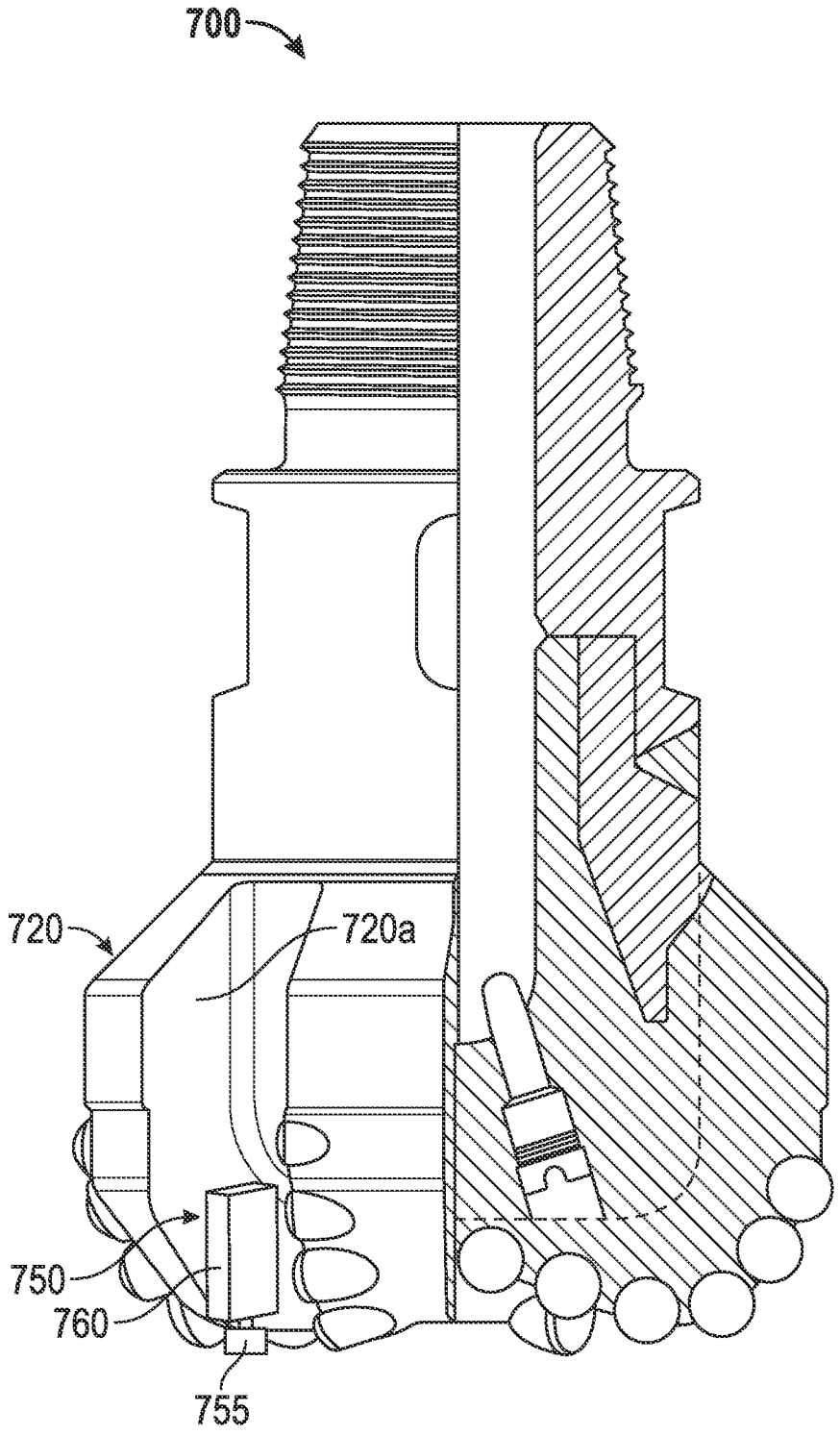
FIG. 7 shows a drill bit, wherein the rate control device and the pad are placed on an outside surface of the drill bit.

FIG. 7 shows a drill bit 700, wherein an integrated pad and rate control device 750 is placed on an outside surface of the drill bit 700. In one aspect, the device 750 includes a rate control device 760 connected to a pad 755. In one aspect, the device 750 is a sealed unit that may be attached to any outside surface of the drill bit 700. The rate control device 760 may be the same as or different from the rate control devices described herein in reference to FIGS. 2-6. In the particular embodiment of FIG. 7, the pad is shown connected to a side 720*a* of a blade 720 of the drill bit 700. The device 750 may be attached or placed at any other suitable location in the drill bit 700. Alternatively or in addition thereto, the device 750 may be integrated into a blade so that the pad will extend toward a desired direction from the drill bit.

Thus, in various embodiments, a rate controller may be a hydraulic actuation device and may be placed at any desired location in the drill bit or outside the drill bit to self-adjust extension and retraction of one or more pads based on or in response to external forces applied on the pads during drilling of a wellbore. The pads may be located and oriented independently from the location and/or orientation of the rate controller in the drill bit. Multiple pads may be inter-connected and activated simultaneously. Multiple pads may also be connected to a common rate controller.

In various embodiments, during stick-slip, the pads can extend relatively quickly at high rotational speed (RPM) of the drill bit when the depth of cut (DOC) of the cutters is low. However, at low RPM, when the DOC start increasing suddenly, the pads resist sudden inward motion and create a large contact (rubbing) force preventing high DOC. Limiting high DOC during stick-slip reduces the high torque build-up and mitigates stick-slip. In various embodiments, the rate controller may allow sudden or substantially sudden extension (outward motion) of a pad and limit sudden retraction (inward motion) of the pad. Such a mechanism may prevent sudden increase in the depth of cut of cutters during drilling. A pressure compensator may be provided to balance the pressures inside and outside the cylinder of the rate controller.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

The invention claimed is:

1. A drill bit, comprising:

a bit body;

a pad that extends from a bit surface at a first rate and retracts from an extended position to a retracted position at a second rate that is less than the first rate; and a rate control device coupled to the pad, the rate control device including:

a fluid chamber, a piston dividing the fluid chamber into a first fluid chamber and a second fluid chamber, and a first fluid flow path from the first fluid chamber to the second fluid chamber that controls movement of the piston in a first direction at the first rate and a second fluid flow path from the second chamber to the first chamber that controls movement of the piston in a second direction at the second rate.

2. The drill bit of claim 1, wherein the rate control device extends the pad at the first rate and retracts the pad at the second rate in response to an external force applied onto the pad.

3. The drill bit of claim 2, wherein the rate control device includes:

a biasing member that applies a force on the piston to extend the pad at the first rate.

4. The drill bit of claim 3, wherein the rate control device is self-adjusting.

5. The drill bit of claim 1, wherein a first check valve in the first fluid flow path defines the first rate and a second check valve in the second fluid flow path defines the second rate.

6. The drill bit of claim 1, wherein at least one of the first rate and the second rate is a constant rate.

7. The drill bit of claim 1, wherein the piston is operatively coupled to the pad by one of: a direct mechanical connection, and via a fluid.

8. The drill bit of claim 1, wherein the rate control device includes a double acting piston operatively coupled to the pad, wherein a fluid acting on a first side of the piston controls at least in part the first rate and a fluid acting on a second side of the piston controls at least in part the second rate.

9. The drill bit of claim 1, wherein the pad is a cutter on the drill bit.

10. A drill bit comprising:

a plurality of cutting elements;

at least one pad; and a rate control device that controls extension and retraction of the at least one pad, the rate control device including:

a fluid chamber, a piston dividing the fluid chamber into a first fluid chamber and a second fluid chamber, and a first fluid flow path from the first fluid chamber to the second fluid chamber that controls movement of the piston in a first direction at the first rate to extend the at least one pad and a second fluid flow path from the second chamber to the first chamber that controls movement of the piston in a second direction to retract the at least one pad at a second rate that is less than the first rate.

11. The drill bit of claim 10, wherein the rate control device self-adjusts extension and retraction of the at least one pad in response to an external force applied on the at least one pad.

12. The drill bit of claim 10, wherein the rate control device comprises:

a double acting piston;

a variable force biasing member that acts on the double acting piston to extend the at least one pad at the first rate; and a fluid that acts on the double acting piston retract the at least on pad at the second rate.

13. The drill bit of claim 12 further comprising a pressure compensator for the fluid.

14. A method of making a drill bit, the method comprising:

providing a drill bit having a bit body and a plurality of cutters;

providing a pad; and providing a passive rate control device in the drill bit and coupling the passive rate control device to the pad, wherein the passive rate control device includes:

a fluid chamber divided by a piston into a first fluid chamber and a second fluid chamber, and a first fluid flow path from the first chamber to the second chamber that controls movement of the piston in a first direction at a first rate and a second fluid flow path from the second chamber to the first chamber that controls movement of the piston in a second direction at the second rate that is less than the first rate.

15. The method of claim 14, wherein coupling the passive rate control device to the pad comprises one of: connecting the pad directly to an extendable member of the passive rate control device, and coupling the pad to an extendable member of the passive rate control device via a fluid link.

16. The method of claim 14, wherein the passive rate control device further includes:

a biasing member that applies a force on the piston to extend the pad at the first rate.

17. The method of claim 14, wherein the passive rate control device further includes a first check valve in the first fluid flow path that defines the first rate and a second check valve in the second fluid flow path defines the second rate.

18. A drilling assembly for drilling a wellbore, comprising:

a drilling assembly having a directional drilling device and a drill bit at an end of the drilling assembly, wherein the drill bit includes:

a plurality of cutting elements;

at least one pad; and a rate control device that controls extension of the at least one pad at a first rate and retraction of the at least one pad at a second rate that is less than the first rate, the rate control device including:

a fluid chamber, a piston dividing the fluid chamber into a first fluid chamber and a second fluid chamber, and a first fluid flow path from the first fluid chamber to the second fluid chamber that controls movement of the piston in a first direction at the first rate and a second fluid flow path from the second chamber to the first chamber that controls movement of the piston in a second direction at the second rate.

19. A method of drilling a wellbore, comprising:

conveying a drill string having a drill bit at an end thereof, wherein the drill bit includes a bit body, a pad that extends from a retracted position to an extended position from a bit surface at a first rate and retracts from the extended position to a retracted position at a second rate that is less than the first rate, and a rate control device coupled to the pad that includes:

a fluid chamber divided by a piston into a first fluid chamber and a second fluid chamber, and a first fluid flow path from the first chamber to the second chamber that controls movement of the piston in a first direction at the first rate and a second fluid flow path from second chamber to the first chamber that controls movement of the piston in a second direction at the second rate; and drilling the wellbore using the drill string.

20. A drill bit, comprising:

a pad in the drill bit; and a passive rate control device operatively coupled to the pad that extends the pad from a surface of the drill bit at a first rate and retracts the pad from an extended position at a second rate, the passive rate control device including:

a fluid camber divided by a piston into a first fluid chamber and a second fluid chamber, and a first fluid flow path from the first chamber to the second chamber that controls movement of the piston in a first direction at the first rate and a second fluid flow path from the second chamber to the first chamber that controls movement of the piston in a second direction at the second rate.

* * * * *